US006550995B2

(12) United States Patent
Hosaka

(10) Patent No.: US 6,550,995 B2
(45) Date of Patent: Apr. 22, 2003

(54) METHOD AND RECORDING APPARATUS FOR DETECTING REAR EDGE OF A RECORDING MEDIUM

(75) Inventor: Chisei Hosaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/871,659

(22) Filed: Jun. 4, 2001

(65) Prior Publication Data

US 2002/0018684 A1 Feb. 14, 2002

(30) Foreign Application Priority Data

Jun. 5, 2000 (JP) ..... 2000-167221

(51) Int. Cl.[7] ..... B41J 13/10
(52) U.S. Cl. ..... 400/624; 400/76; 400/70
(58) Field of Search ..... 400/624, 76, 70, 400/1

(56) References Cited

U.S. PATENT DOCUMENTS 4,507,667 A * 3/1985 Tsuboi ..... 347/197
5,539,510 A * 7/1996 Yamashiro et al. ..... 399/137

FOREIGN PATENT DOCUMENTS

JP 4-279371 A * 10/1992 ..... B41J/11/42
JP 10-58801 3/1998

OTHER PUBLICATIONS

Machine Translation of JP 10–058801 A. Published Mar. 1998. Translated Apr. 2002.*

* cited by examiner

*Primary Examiner*—Andrew H. Hirshfeld
*Assistant Examiner*—Charles H. Nolan, Jr.
(74) *Attorney, Agent, or Firm*—Fitzpatrick, Cella, Harper & Scinto

(57) ABSTRACT

The present invention relates to a method of detecting a rear edge of a recording medium using a passage detection lever for swinging in association with a passage of the rear edge of the recording medium, and a detection sensor for detecting swinging movement of the passage detection lever. The present invention comprises the steps of detecting a conveying quantity of the recording medium at a prescribed interval recording a past data of the conveying quantity and determining a position of the rear edge of the recording medium based on the recorded past data with consideration of a physical returning time starting from a point of time when the rear edge of the recording medium passes the passage detection lever and causes the swinging of the passage detection lever to a point of time when the detection sensor detects the swinging movement.

5 Claims, 6 Drawing Sheets

METHOD AND RECORDING APPARATUS FOR DETECTING REAR EDGE OF A RECORDING MEDIUM

BACKGROUND OF THE INVENTION

1. Field of the Invention

This invention relates to a method and recording apparatus for detecting a rear edge of a recording medium with a recording apparatus.

2. Description of Related Art

Conventionally, as a means to detect a sheet being a recording medium, a recording apparatus such as a serial type ink jet printer or the like was provided with a swinging type passage detection lever for swinging depending on a presence of a sheet, and a detection sensor of an optic type or the like for detecting a movement of the passage detection lever, wherein the passage detection lever and the detection sensor are arranged upstream at a prescribed distance apart from a recording head on a sheet conveying path. At a point of time when the detection sensor detects the movement of the passage detection lever, a control means manages a position of the sheet, and omits a portion of a printing data exceeding a length of a remaining area between a recording position of the recording head to a rear edge of the sheet based on the length of the remaining area, and proceeds printing. However, a mechanically driven type sheet detection means as the above causes a delay of sheet detection associating with the swinging of the passage detection lever. Although the delay time of the sheet detection is the same, a conveyed quantity during this time of delay would differ depending on a sheet conveying speed; accordingly, a method of determining the position of the rear edge of a sheet based on a maximum value of a sheet conveying speed or a method of detecting the position of the rear edge of a sheet according to a sheet conveying speed (Japanese Publication Hei10-058801) have been used.

Nevertheless, in respect of the conventional recording apparatus, a sheet conveying quantity differed depending on a printing content, and further, in a case where the sheet conveying quantity is small or in a case where a passage detection lever had been activated right before a cease of conveying, the detection sensor proceeds detection from a position where the conveying had ceased. Subsequently, the detection of the length of a remaining area between a recording position of the recording head to a rear edge of the sheet would become indefinite and variable; therefore, in a case where position is not adjusted, a design error was accumulated and printing was performed by maximizing a margin space to prevent discharging upon a platen portion.

This invention is aimed to improve printing quality by reducing a margin space of a rear edge of a recording medium in a case where the recording medium conveyed in a conveying direction is shorter than a data for printing.

SUMMARY OF THE INVENTION

In means to solve the foregoing problems, this invention provides a method of detecting a rear edge of a recording medium comprising: a passage detection lever for swinging in association with a passage of the rear edge of the recording medium; and a detection sensor for detecting the swinging movement of the passage detection lever, wherein the method of detecting the rear edge of the recording medium comprises the steps of: detecting a conveying quantity of the recording medium at each prescribed period; recording a past data of the conveying quantity of the recording medium; evaluating a physical returning time starting from a point of time when the rear edge of the recording medium has passed the passage detection lever to a point of time when the detection sensor detects the passage detection lever; and detecting a position of the rear edge of the recording medium based on the recorded past data regarding the conveying quantity of the recording medium.

In means to solve the foregoing problems, this invention further provides a recording apparatus for recording upon a recording medium by a recording head, wherein the recording apparatus comprises a memorizing means for detecting a recording medium conveying quantity at each prescribed period and memorizing the recording medium conveying quantity as a past data; a passage detection lever swinging in association to a passage of a rear edge of a recording medium; a detection sensor for detecting the swinging movement of the passage detection lever; and a controlling means for determining a position of the rear edge of a recording medium by evaluating a physical returning time starting from a point of time when the rear edge of the recording medium has passed the passage detection lever to a point of time when the detection sensor detects the passage detection lever

BRIEF DESCRIPTION OF THE DRAWINGS

The above and other objects and features of the invention are apparent to those skilled in the art from the following preferred embodiments thereof when considered in conjunction with the accompanied drawings, in which.

DESCRIPTION OF THE PREFERRED EMBODIMENTS

An embodiment provided with the recording apparatus regarding this invention will hereinafter be specifically described with reference to the drawings. In the description below, an ink-jet recording type printer, which discharges ink in accordance to signals, is given as an example for the recording apparatus.

Figure 1:
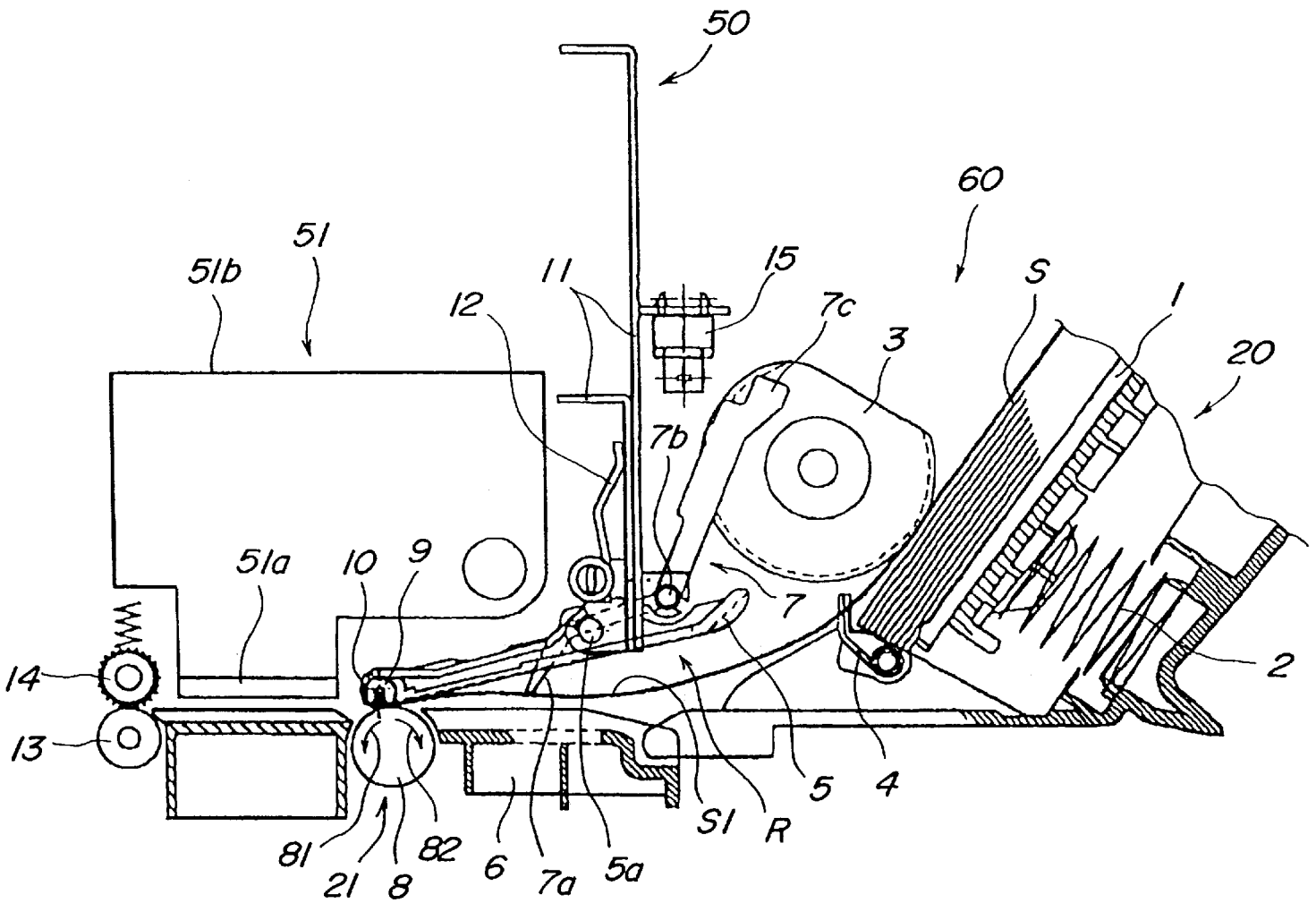
FIG. 1 is a cross-sectional view showing a schematic structure of a recording apparatus regarding an embodiment of this invention.

FIG. 1 is a cross-sectional view of an ink-jet printer regarding this embodiment in which numeral 50 is a recording apparatus including an image forming portion 51, and numeral 60 is sheet conveying device. This sheet conveying device 60 is provided with: a sheet containing portion 20 for containing sheet S; a sheet feeding roller 3 for feeding a sheet S contained inside the sheet containing portion 20; a separation claw 4 arranged downstream of a sheet feeding direction of the sheet containing portion 20 and serving to separate sheet S fed from the sheet feeding roller 3; and a conveying portion 21 for conveying the sheet S separated by the separation claw 4 to the image forming portion 51.

The sheet containing portion 20 is loaded with sheet S and is also provided with a pivotally movable sheet feeding thick plate 1 having a pivotal movement shaft (not shown) as a center. A thick plate spring 2 causes the sheet feeding thick plate to urge upon the sheet feeding roller 3.

The sheet feeding roller 3 has a shape of a half-moon with a partially cut-out outer periphery, and owing to a locking mechanism (not shown), the cut-out portion is stopped in a state facing the sheet S when the sheet feeding roller 3 is in a waiting state after the feeding of the sheet. In the foregoing waiting state, the sheet feeding thick plate 1 is also in a state pressed downward to the side distanced from the sheet feeding roller 3 owing to a cam mechanism (not shown); accordingly, the sheet feeding roller 3 and the sheet S are in a state noncontacting state.

The conveying portion 21 is provided with: a conveying guide 6; a pinch roller folder 5 forming a sheet conveying path R together with the conveying guide 6; a sheet conveying roller 8 capable of pivotally rotating in a direction of arrow 81 or arrow 82 owing to a driving mechanism (not shown); and a pinch roller 9 rotatably maintained at a tip portion of the pinch roller folder 5 via a pinch roller shaft 10.

The pinch roller folder 5 is pivotally supported to a chassis 11 of the recording apparatus 50 in a swingable manner via swingable shaft 5*a;* and is urged in a direction where the pinch roller 9 is pressingly contacted to the sheet conveying roller 9 with a prescribed pressure owing to a twisted coil 12 arranged between the chassis 11 and the pinch roller folder 5.

The image forming portion 51 is provided with a recording head 51*a;* and a carriage 51*b* maintaining the recording head 51*a* and serving to shift in a direction perpendicularly intersecting with a sheet conveying direction. The sheet S1 is conveyed to a recording position by the sheet conveying roller 8 rotating in a direction of arrow 81 and then, the recording head 51*a* records upon the sheet S1 by a shifting of the carriage 51*b*.

As shown in FIG. 1, the passage detection lever 7 is pivotally supported to the chassis 11 in a swingable manner via a swingable shaft 7*b,* and a one end portion 7*a* is projected within the sheet conveying path for detecting a presence of sheet S. A detection sensor 15 serves to detect an other end portion 7*c* of the passage detection lever 7.

When the sheet S1 passes the sheet conveying path R and presses against the one end portion 7*a,* the passage detection lever 7 swings in a clock-wise direction having the swinging shaft 7*b* serve as a fulcrum (shown in FIG. 1). Subsequently, the swinging movement of the passage detection lever 7 causes the other end portion 7*c* to shift so that the detection sensor 15 detecting the shift would output a detection signal to a control means (see FIG. 4) for controlling a driving mechanism (described afterwards).

As shown in FIG. 1, numeral 13 is a sheet discharging roller and numeral 14 is a spur, in which the recorded sheet S1 is discharged from a sheet discharging tray (not shown) by the sheet discharging roller 13 and the spur 14.

The use of the spur 14 was selected since the area contacting with the sheet is small and also a disarrangement of the image recorded upon the sheet would not occur.

Next, a method of conveying a sheet for printing with an ink-jet printer regarding this embodiment will hereinafter be described with reference to the drawings.

Figure 2:
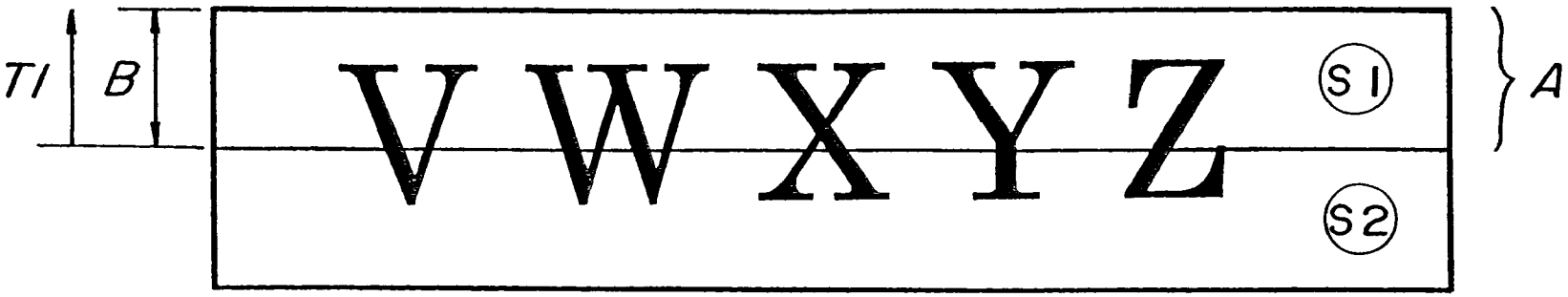
FIG. 2 is an explanatory view of a recording configuration regarding this invention.

In a case of printing the letters "VWXYZ" as shown in FIG. 2, when the recording head is capable of printing a width of size B (indicated with an arrow in the drawing), a sheet is conveyed to a recording position A, and then, a first segment S1 is printed, and then, a conveying motor is driven again, and then, the sheet is conveyed with a conveying quantity T1 (T1 equals to the printable width of the recording head B), and then, a second segment S2 is printed.

Figure 3:
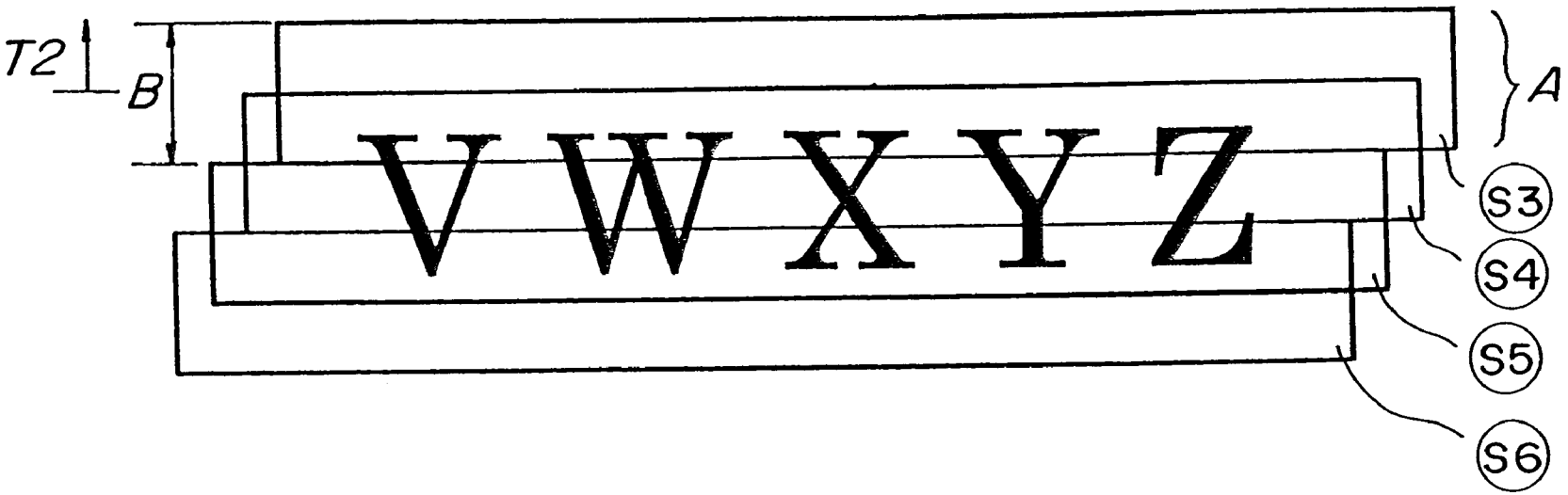
FIG. 3 is an explanatory view of a recording configuration regarding this invention.

Typically, an ink-jet printer prints upon a same portion several times for correcting dispersedly discharged areas of the nozzles of the recording head. FIG. 3 shows a method of twice printing upon a same portion. When printing upon the same portion, with respect to the printable width B a conveying quantity would be T2 (T2 being less than T1). In the case of printing the letters "VWXYZ", the sheet is conveyed to the recording position A, and then, printing is performed with a mask so that an image of a third segment S3 could be completed by twice printing, and then, the sheet is conveyed with the conveying quantity T2 (as the size shown by the arrow). Regarding a fourth segment S4, a remaining portion of the third segment S3 and a lower portion of the fourth segment S4 is printed with a mask, and by repeating the printing and conveying procedure upon a fifth segment S5 and a sixth segment S6, the printing process completed.

Although, a printing method by twice printing in an overlapping manner is described above, the overlapping printing could be performed more times to perform a printing of a higher grade, and in such case, the sheet would be conveyed having a lower conveying quantity than the above. Accordingly, a conveying speed is variable depending on the grade of printing.

Figure 4:
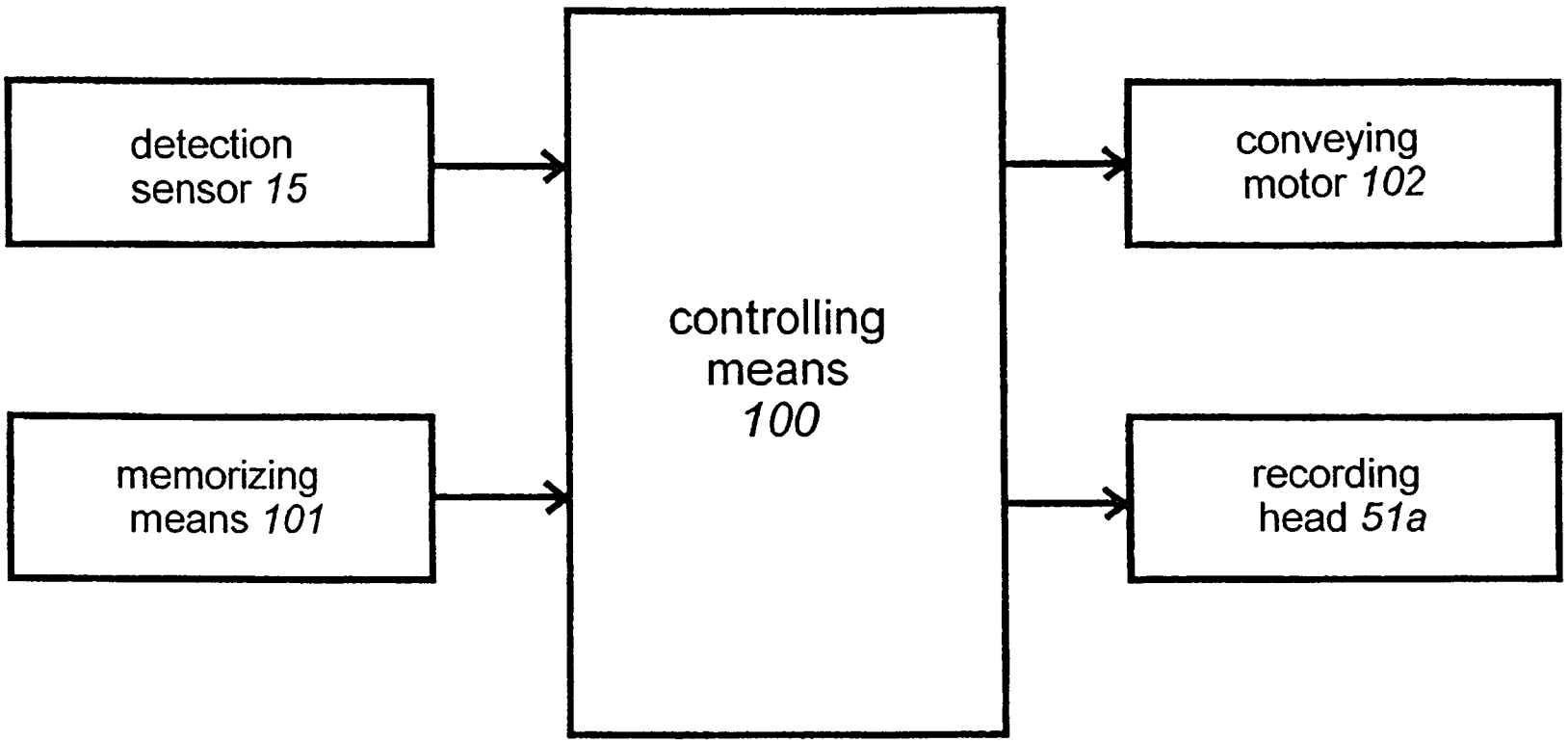
FIG. 4 is a schematic structural view of a control system regarding this invention.

A schematic structural view of a control system of this apparatus is shown in a block diagram of FIG. 4. Numeral 15 is a detection sensor for detecting the passage detection lever 7, which swings by a passage of a sheet. Numeral 101 is a memorizing means, which includes a timer for performing a predetermined timed cut-in, and memorizes the sheet conveying quantity during the cutting-in time. Numeral 100 is a controlling means for determining an actual detection time of the rear edge of the sheet (time when the rear edge of the sheet passes the passage detection lever) based on the period of time when the detection sensor performs detection and based on the sheet conveying quantity memorized by the memorizing means.

The controlling means 100 determines the actual detection time of the rear edge of the sheet based on the time when the detection sensor performs detection and the sheet conveying quantity memorized by the memorizing means; subsequently, based on this information, the controlling means 100 controls a driving regarding a sheet conveying motor 102 for driving the sheet conveying roller 8 or the like, and a recording head 51*a*.

Figure 5:
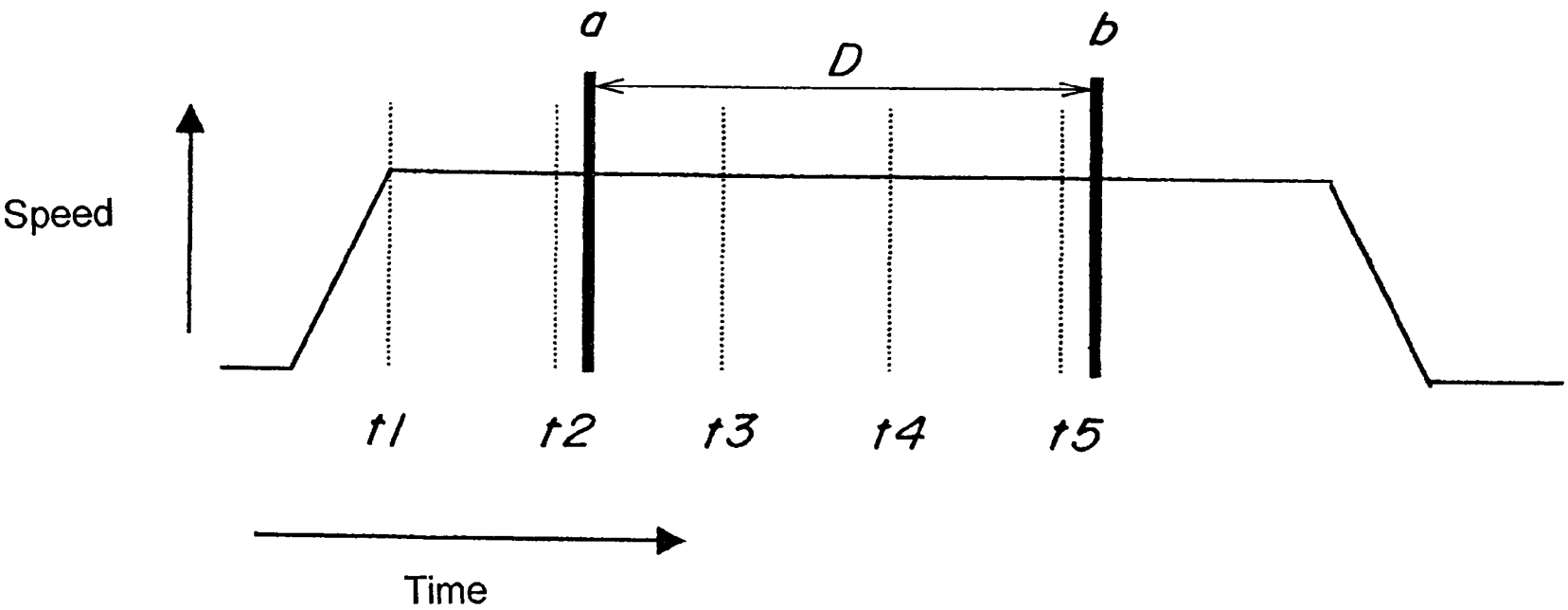
FIG. 5 is an exemplary view showing a point of time for detecting a rear edge of a sheet.

Next, a movement of a motor corresponding to the conveyance and a point of time for detecting the rear edge of a sheet will hereinafter be described with reference to the drawings. FIG. 5 is an example showing a point of time for detecting the rear edge of a sheet in a case where the sheet conveying quantity is large. A vertical axis indicates a rotation speed of the sheet conveying motor, and a horizontal axis indicates an elapsed time. Referring to the drawing, during when the sheet conveying motor is being driven, the passage detection lever would swing at a point of time a when the rear edge of a sheet passes the passage detection lever 7, and then, the detection sensor 15 detects the other end portion 7*c* of the passage detection lever 7 at a point of time b when a substantially uniform physical returning time elapses. The term "physical returning time" refers to the time starting from when the rear edge of the sheet passes the one end portion 7*a* of the passage detection lever 7 until when the detection sensor 15 detects a movement of the other end portion 7*c* of the passage detection lever 7. Meanwhile, the value of the sheet conveying quantity is memorized at each point of time t1, t2, t3, t4, t5 (as shown with the broken lines) owing to the predetermined timed cut-in. Supposing that the interval for the cut-in is 10 msec, and supposing that the physical returning time from the passage of the rear edge of the sheet to the detection is 30 msec, the rear edge of the sheet is determined by referring to the point of time detected by the sensor starting from the point of time t5 to the point of time t2 (third value previous from the point of time t5). Accordingly, at the point of time t2, the rear edge of the sheet is confirmed to be in a position at the one end portion 7*a* of the passage detection lever 7, and the conveying quantity at this point of time could be confirmed. At this point of time, the remaining recordable distance could be determined considering that the distance between the recording head 51 and the one end portion 7*a* of the passage detection lever 7 is uniform; based on the conveying quantity at the point of time t2, the actual recordable distance could be extracted by subtracting the distance till a present point of time b.

In FIG. 5, when the position of t5 completely coincides to the position of b, an interruption having a higher priority enters first between the b-interruption and the periodical timer interruption. When b comes between t4 and t5, the value taken at t1 is selected, and the value of t2 is selected even where b is detected during 10 msec between t5 and t6 (not shown).

Figure 6:
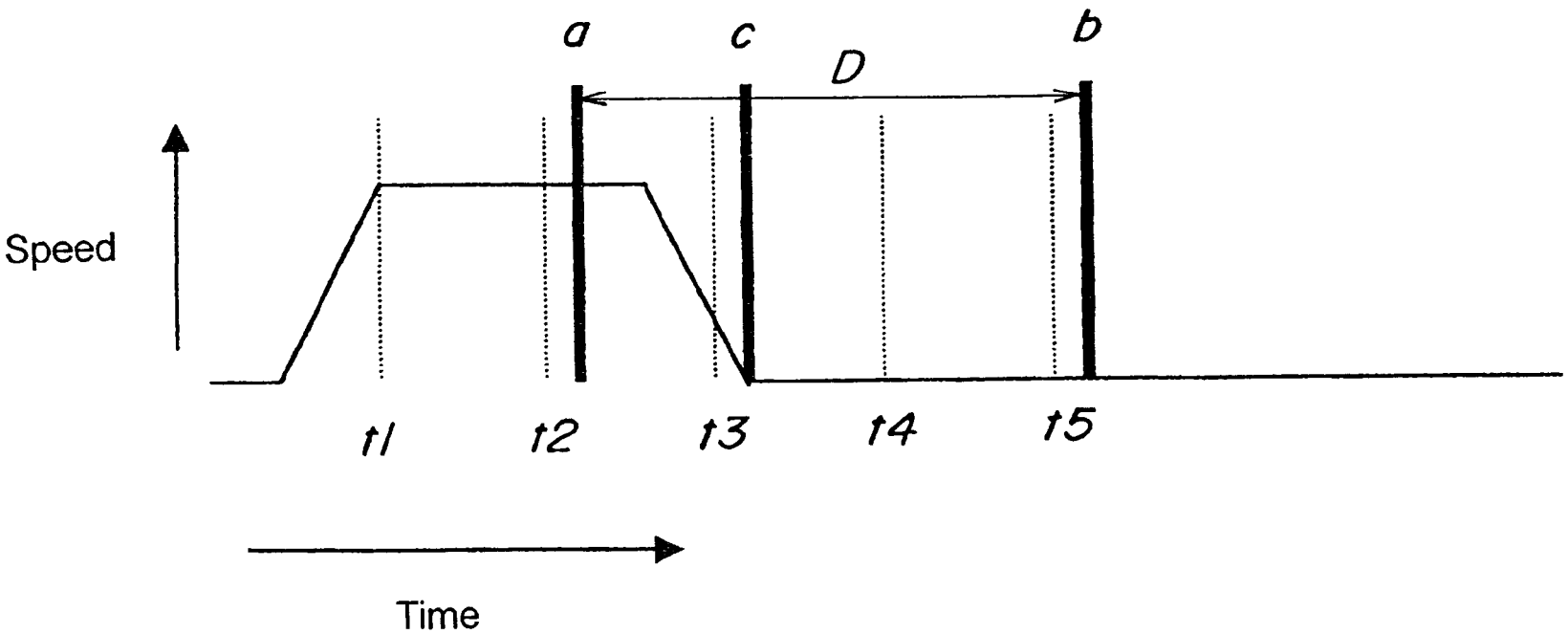
FIG. 6 is an exemplary view showing a point of time for detecting a rear edge of a sheet.

FIG. 6 is an example showing a point of time for detecting the rear edge of a sheet in a case where the sheet conveying quantity is small and where the sheet conveying has stopped before a delaying detection of the detection sensor. In a same manner as FIG. 5, at a point of time a when the rear edge of a sheet passes the passage detection lever 7, the detection sensor 15 performs detection at a point of time b when the physical returning time D has elapsed. In terms of a conventional detection method such as a detection method based on the speed of a motor, even if the conveying quantity at the point of time c could be detected, the actual point of time of the passage of the rear edge a could not be estimated since the conveying has already stopped at the time of the detection.

Therefore, in a same manner has FIG. 5, at a point of time when the detection sensor 15 detects the other end portion 7*c* of the passage detection lever 7, even when the conveying has already stopped, this invention determines the rear edge of the sheet by evaluating the physical returning time (30 msec) and by referring to the point of time t2 (third value previous from the point of time t5).

Further, FIG. 6 is an exemplary view showing a case where the sheet conveying quantity is small or when an LF motor lamp is down.

Conventionally, since the sheet conveying is ceased at the point of time c, the value of the conveying quantity detected at the point of time b would be c. Even if the actual swinging movement of the lever starts at the point of time t2 or at t1, the sheet conveying value would be c since the motor is already ceased at the point of detection.

In this embodiment, when the actual point of the swaying movement of the passage detection lever is a, the memorized sheet conveying quantity at the point of time t2 is to become the actual position of the rear edge. For example, in a case where the point of time of detection of the detection sensor is t4, the memorized sheet conveying quantity at the point of time t1 is to become the effective value of the sheet conveying quantity.

This invention determines how much is printable from the present printing position and defines the printing area based on the position of the rear edge of the sheet and based on the distance between the passage detection lever and the printable position.

As shown in FIG. 5 and FIG. 6, even if the conveying quantity differs, the position of the rear edge of the recording medium could be precisely detected since the conveying quantity is monitored at t1 through t5. Accordingly, in terms of a recording apparatus capable of changing over from a normal recording mode to a fine recording mode, a more precise control is possible.

Although the conveying quantity regarding this embodiment is memorized with an interval of 10 msec, the position of the rear edge of the sheet could be detected more precisely by shortening the predetermined interval for cutting-in.

In consequence, even when a recording data larger than the recording medium is sent in the conveying direction, this invention could reduce the unrecordable margin space since this invention performs recording by memorizing the past data of conveying quantity at each prescribed period; extracting the position where the recording medium had actually activated the passage detection lever by evaluating the physical returning time necessary for detecting the recording medium; and determining the rear edge of the recording medium from the extracted position.

What is claimed is:

1. A method of detecting a rear edge of a recording medium using a passage detection lever configured to swing upon passage of the rear edge of the recording medium, and a detection sensor for detecting the swinging movement of the passage detection lever, the method comprising the steps of:

detecting conveying quantity data of the recording medium at a predetermined interval;

storing the conveying quantity data in a memory; and calculating a conveyance distance of the recording medium based on a past data point of the stored data selected in accordance with a physical returning time starting from a point of time when the rear edge of the recording medium passes the passage detection lever and causes the swinging of the passage detection lever to a point of time when the detection sensor detects the swinging movement.

2. The method of detecting the rear edge of the recording medium according to claim 1, wherein, when the conveying quantity is stored at intervals t1 through tn, and D indicates the physical returning time, a data point of the stored conveying quantity data immediately preceding tn-D is taken as the conveying quantity at the point of time that the rear edge of the recording medium passes the passage detection lever to determine a printable area of the recording medium.

3. A recording apparatus configured to detect a rear edge of a recording medium, the apparatus comprising:

a conveyor arranged to convey the recording medium to a recording means;

a conveying quantity detector arranged to detect conveying quantity data of the recording medium at a predetermined interval;

a memory arranged to receive and store the conveying quantity data;

a passage detection lever arranged upstream of the recording means and configured to swing upon passage of the rear edge of the recording medium;

a detection sensor positioned to detect the swinging movement of the passage detection lever; and a controller for calculating a conveyance distance of the recording medium based on a past data point of the stored data selected in accordance with a physical returning time starting from a point of time when the rear edge of the recording means passes the passage detection lever and causes the swinging of the passage detection lever to a point of time when the detection sensor detects the swinging movement.

4. The recording apparatus according to claim 3, wherein the controller evaluates the physical returning time and determines a conveying quantity during the passage of the rear edge of the recording medium and determines a printable area based on the determined conveying quantity.

5. The recording apparatus according to claim 3, wherein the passage detection lever comprises a first swinging end portion that contacts the recording medium, and a second swinging end portion facing the detection sensor.

* * * * *